United States Patent [19]

Kuhbier

[11] 4,304,421

[45] Dec. 8, 1981

[54] SKI SAFETY BRACKET

[75] Inventor: Peter Kuhbier, Wipperfuerth, Fed. Rep. of Germany

[73] Assignee: Maria Kubbier, Wipperfürth, Fed. Rep. of Germany

[21] Appl. No.: 45,588

[22] Filed: Jun. 4, 1979

[30] Foreign Application Priority Data

Jun. 5, 1978 [DE] Fed. Rep. of Germany ..... 2824581

[51] Int. Cl.[3] ..... A63C 11/00

[52] U.S. Cl. ..... 280/817; 403/97; 403/146

[58] Field of Search ..... 280/809, 813, 817, 602; 403/97, 146, 147

[56] References Cited

U.S. PATENT DOCUMENTS

| | | | |
|---|---|---|---|
| 3,148,891 | 9/1964 | Heuvel | 280/817 |
| 3,951,425 | 4/1976 | Lohr | 280/817 |
| 3,953,043 | 10/1974 | Hinterholzer | 280/817 |
| 4,131,291 | 12/1978 | Thon | 280/817 |
| 4,174,117 | 11/1979 | Hinterholzer | 280/817 |
| 4,189,163 | 2/1980 | Schweizer et al. | 280/817 |

FOREIGN PATENT DOCUMENTS

| | | | |
|---|---|---|---|
| 158726 | 11/1939 | Fed. Rep. of Germany | 403/146 |
| 1058791 | 11/1953 | France | 280/602 |
| 1336333 | 7/1963 | France | 403/97 |

*Primary Examiner*—Joseph F. Peters, Jr.
*Assistant Examiner*—D. W. Underwood
*Attorney, Agent, or Firm*—Michael J. Striker

[57] ABSTRACT

A ski safety device for deflecting a ski leaving its direction from crossing over to the other ski, has two brackets each movable between a normal position in which it extends upright to the respective ski, and a folded position in which it folds down toward the same with resistance. The brackets pivot in the direction of travel and about an axis which is transverse to this direction.

15 Claims, 12 Drawing Figures

SKI SAFETY BRACKET

BACKGROUND OF THE INVENTION

This invention relates to a ski safety bracket intended to prevent the dangerous crossing of skis during a run. Very many skiing accidents occur by one ski of a pair of skis being directed away from the direction of travel by contact with an irregularity in the ground by an object lying on the slope etc. Especially at higher travelling speeds, accidents with severe consequences frequently result therefrom.

On crowded ski slopes, there is a steep increase in the danger of other skiers becoming involved in such a fall. In view of the general import of the danger of crossing, some devices have recently become known, having as their objective the prevention of the crossing of skis during a run. It is common with all these devices, that they are arranged in the form of a bracket standing vertically, or that of a disc, located between the ski bindings and the ski slope, at about the middle of this section of the ski or somewhat closer to the slope, depending upon the length of the ski. One ski deflector, well received by the market, consists of a plastic housing of trapezium-shaped section open towards the tip of the skis and towards the bindings. This housing is attached to a base plate bonded to the ski, by set parallel to the longitudinal axis of the ski, by a retainer pin which allows removal. Should one, of a pair of skis, deviate from the direction of travel and pivot towards the second ski, it will be deflected in such an instance by the ski safety bracket; if the skier keeps the ski firmly to the slope, a crossing of the skis will not ensue.

Most of the known deflecting devices are designed as per this scheme and are good in solving their primary task, the deflection of a crossing ski. They do however constitute a potential danger of injury which must be taken seriously, since especially at higher travelling speeds they may lead to severe head injuries if, in a fall, the skier's head should impact on the deflector. Herein, it is the eyes that are primarily endangered. It is not only the fall per se, but as a consequence of the fall, skier and skis will sometimes repeatedly rotate around themselves, so that the chance of injuring the head on the deflector is repeatedly present.

SUMMARY OF THE INVENTION

The present invention has set as its objective to create a ski safety bracket which, on one hand will solve in an optimal manner the task of reliably deflecting from the second ski of a pair of skis, the ski deviating from the direction of travel, and which, on the other, will immediately fold down upon body contact during or after the fall, and which will, in the rolling during a fall, remain closed under all circumstances. If, however, aided by an irregularity of the slope or by an object lying on the slope, the crossing ski has jumped over the ski safety bracket, the latter should have a design feature which will facilitate returning of the ski into its original running position.

These objectives of the invention are realized by so arranging the ski safety bracket, which in its normal position is standing up, that it can fold down towards the surface of the ski around a pivotal axis located close to the surface of the ski, wherein the folding down is ensuring against a resistance. For this purpose the side members of the ski safety bracket are designed with hinge parts reaching in an elastic and pressure-exerting manner around a hinge piece arranged directly or indirectly on the ski surface and linked to it with a hinge pin, wherein a stop will limit the pivoting of the ski safety bracket towards the back (in the direction towards the skier). The hinge piece as well as the stop can be incorporated into a retainer plate to be attached to the ski surface; flutes may be shaped into the plate to increase the elasticity of this retaining plate and to prevent that it could detach itself from the ski, or break, due to vibrations of the ski resulting from travel.

In a particularly advantageous version of the hinge parts and the hinge piece, their abutting surfaces are toothed.

The side member of the ski safety bracket at the inside, pointing towards the other ski of the pair of skis, is suitably set at the inclination of about 80° to the plane of the ski, whilst the external side member will form with the plane of the ski, an angle of approximately 60°. The external side member may be provided with notches in the shape of steps of stairs. To reduce the danger of impact, the retaining plate may be provided with a protector plate which will compensate for the abrupt differences in height formed by the hinges.

In a different version of the invention, a hinge piece is arranged directly or indirectly at every longitudinal edge of the ski, each of which being abutted by a hinge part incorporated into the side member of the ski safety bracket, wherein an adjustable tensioning is provided between the hinge parts of the side members. This tension device may, for instance, consist of two discs with toothing formed by helically rising teeth, which can rotate against each other around a common axis, and which are resting against spring elements which, in turn rest, pretensioned, against the inner surfaces of the hinge parts of the ski safety bracket. The teeth of the toothing may be arranged within three angular sectors of equal dimension, the teeth having their lowest level at the beginning of every angular sector and their highest level at the end of every angular sector rising helically in the space between, with the three lowest teeth being in the same lowest plane and the three highest teeth being in the same highest plane. Grooves for gripping can be provided at the circumference of every toothed disc.

The novel features which are considered as characteristic for the invention are set forth in particular in the appended claims.

The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
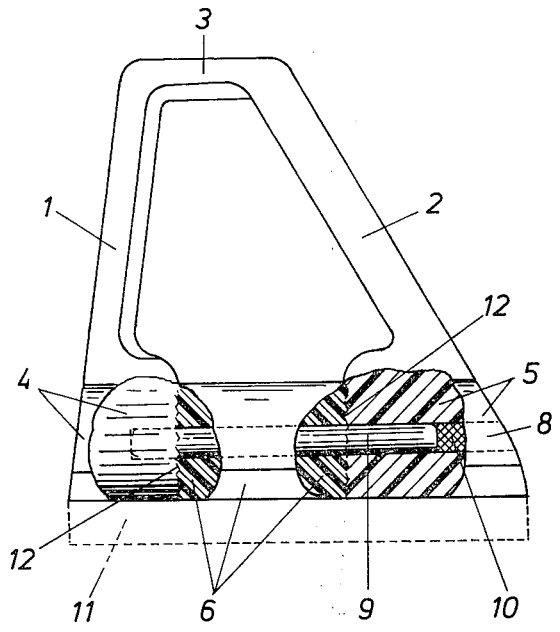
FIG. 1 is a ski safety bracket as per invention in rear view (seen from the ski binding) in partial cross section.
Figure 2:
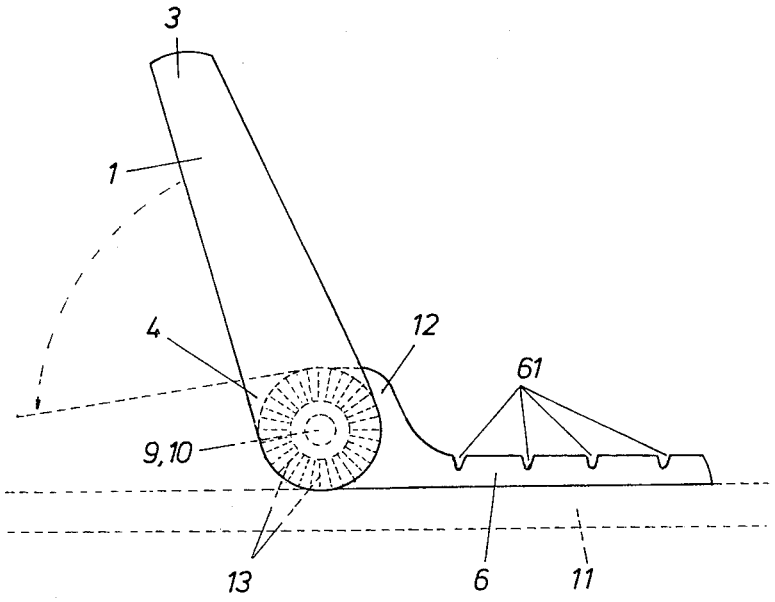
FIG. 2 is the ski safety bracket FIG. 1 in a side view wherein the position of the folded-down bracket is indicated by a broken line.
Figure 3:
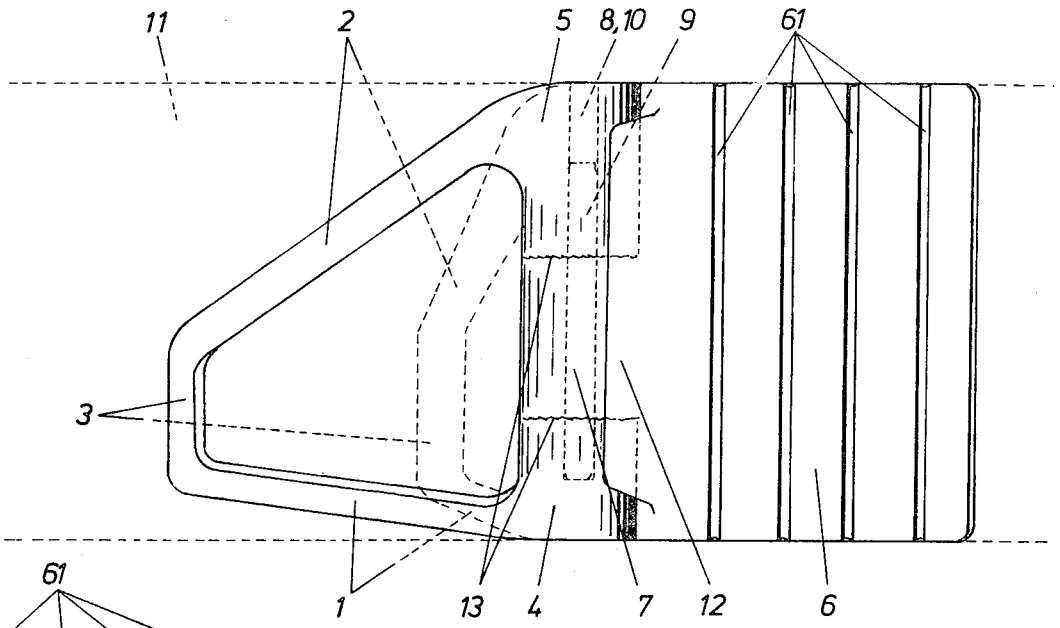
FIG. 3 is the ski safety bracket FIGS. 1 and 2, seen from the top, with a folded-down bracket part (upright position indicated by broken line)

The ski safety bracket is in the shape of a bracket open towards the bottom, with the side members 1,2 being linked to each other towards the top by a bridge 3 and incorporating hinge parts 4,5 at their open ends. The ski safety bracket 1,2,3 is a one-piece plastic injection molding and has a certain hard elasticity at the bridge 3, so that the two hinge parts 4 and 5 can slightly oscillate outward when force is applied.

The ski safety bracket 1,2,3 is linked to a hinge part 7 incorporated into the retaining plate 6, by inserting a hinge pin 9 into a common bore 8 and enclosing the pin by a plug 10.

The retaining plate 6 and the hinge piece 7 are, like the ski safety bracket, a one-piece plastic injection molding; the hinge pin 9 may consist of steel, but also of plastic, and a plastic compound may be used as plug 10.

The retaining plate 6 is bonded to the front half of the ski shown by a broken line and indentifid by reference numeral 11 or attached in any other manner, the distance from the tip of the ski being about 250 mm to 300 mm with skis of normal length. To prevent loosening of the bonding, or breaking of the retaining plate 6 respectively, by the vibratory movement of the ski, the retaining plate is provided with transverse flutes which will increase its elasticity.

The ski safety bracket is installed on the retaining plate 6 by forcing the side members 1,2 so far apart that the hinge parts 4,5 of the bracket will reach around the hinge piece 7 of the retaining plate 6 and will, after releasing the side members, firmly rest against the hinge piece, exerting a certain, not inconsiderable contact pressure against the surface they rest on. If the dimensions of the ski safety bracket and the hinge piece 7 are of sufficient precision, the frictional resistance of smooth or simply roughened hinge faces suffice to reliably keep the ski safety bracket in its upright position. The longitudinal axis of the ski safety bracket in its upright position is at an angle of about 70° with the plane of the front section of the ski; the return pivoting of the bracket part until this upright position is limited by a stop 12 on the retaining plate 6, or incorporated into the hinge piece 7 respectively.

As already noted at the beginning, it is the purpose of the bracket parts being foldable to avoid that in a fall, the skier could injure the head, the chest or any other part of the body against the upright ski safety bracket. Any conceivable fall must, of course, be considered herein and not only a fall caused by crossing of the skis.

Folding-down must be of such an easy action that the bracket part will give immediately when coming into contact with a part of the body. On the other hand, the frictional resistance of the hinge 4,5,7 must be sufficiently high to resist concussions or to withstand such waves of snow, as are thrown from the rear onto the ski safety bracket by passing skiers.

Figure 4:
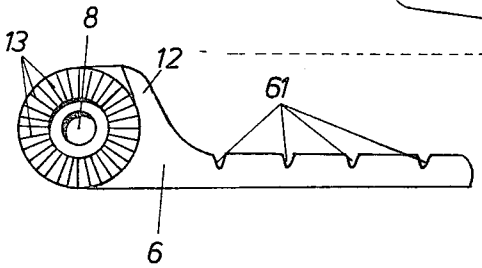
FIG. 4 is the retaining plate of the ski safety bracket in a side view.
Figure 5:
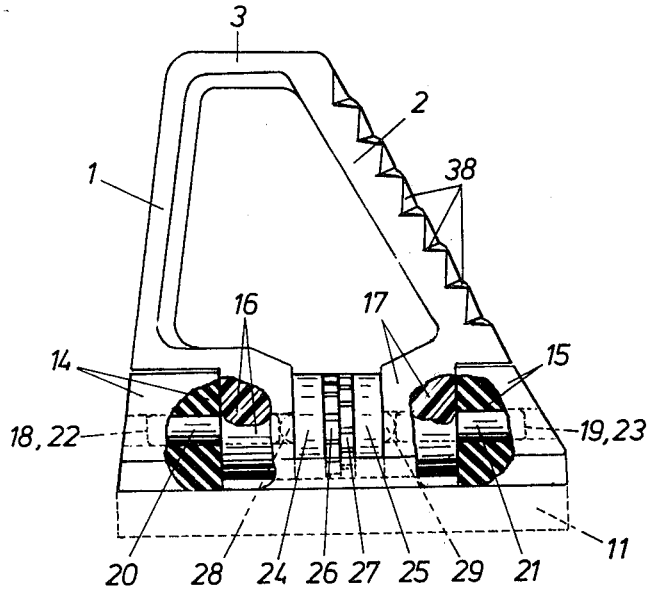
FIG. 5 is a rear view of a ski safety bracket provided with an adjustable resistance against folding-down of the bracket part.
Figure 6:
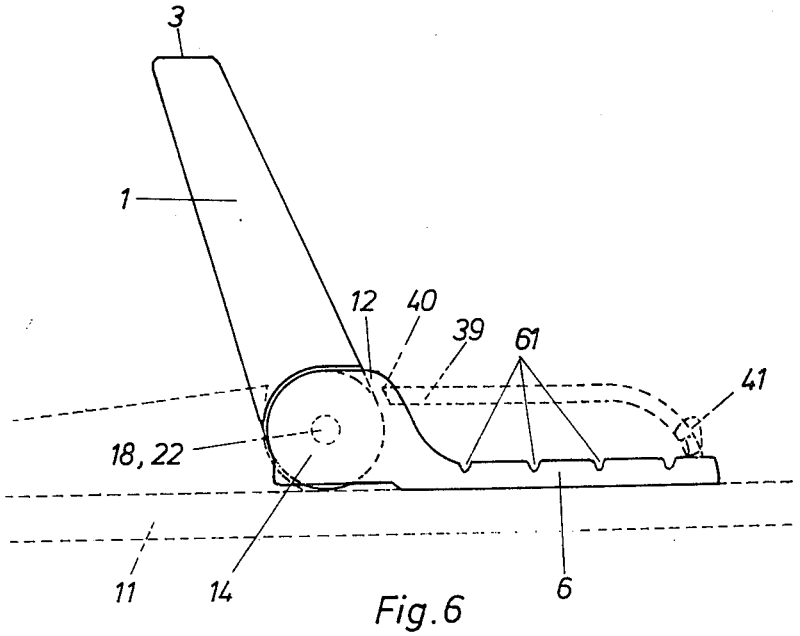
FIG. 6 is the ski safety bracket FIG. 5 in side view, in which the broken lines indicate the position of the bracket part after folding down, as well as a protector plate which can optionally be inserted as an additional protection against injuries from falls.
Figure 7:
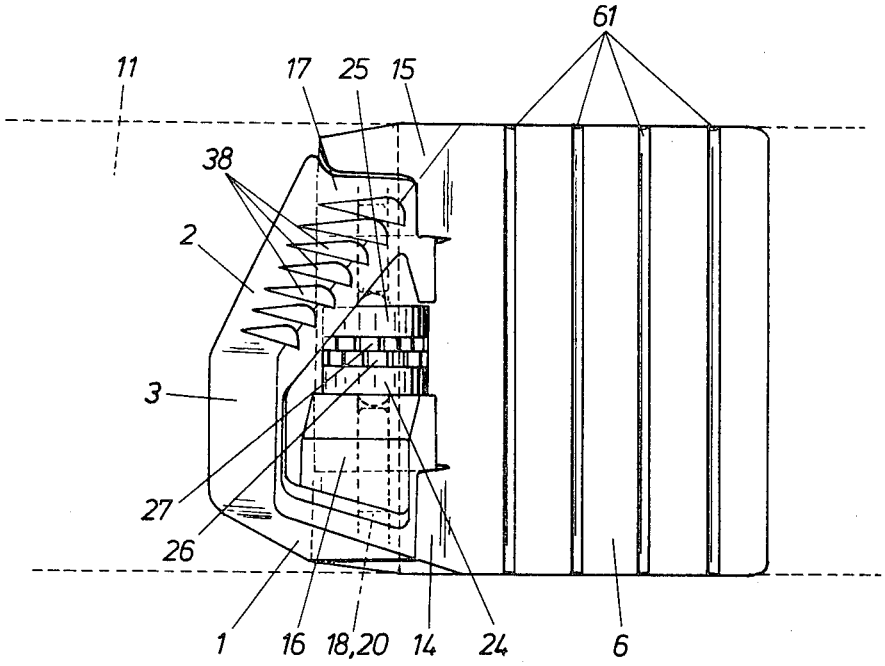
FIG. 7 is the ski safety bracket FIG. 6 in a top view.
Figure 8:
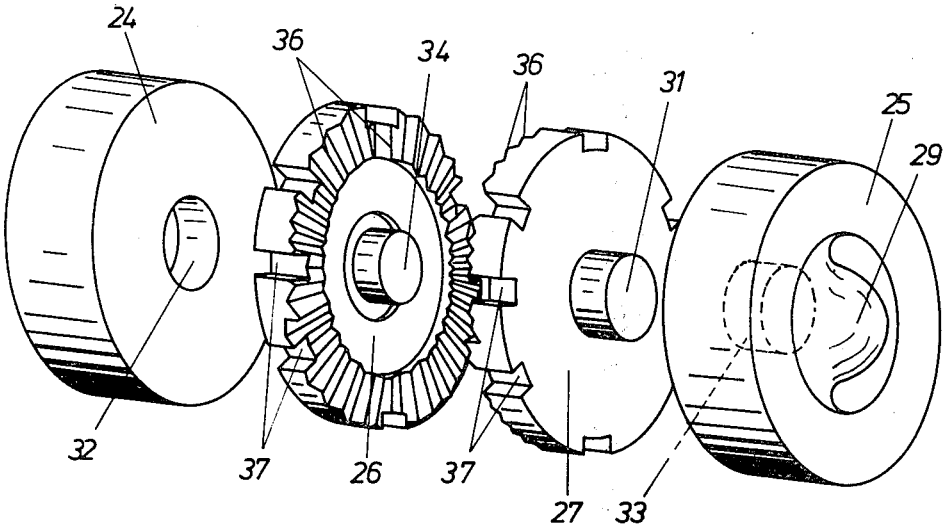
FIG. 8 is an enlarged representation of the individual components of the tension device for the ski safety bracket FIG. 5, in an exploded perspectivic view.
Figure 9:
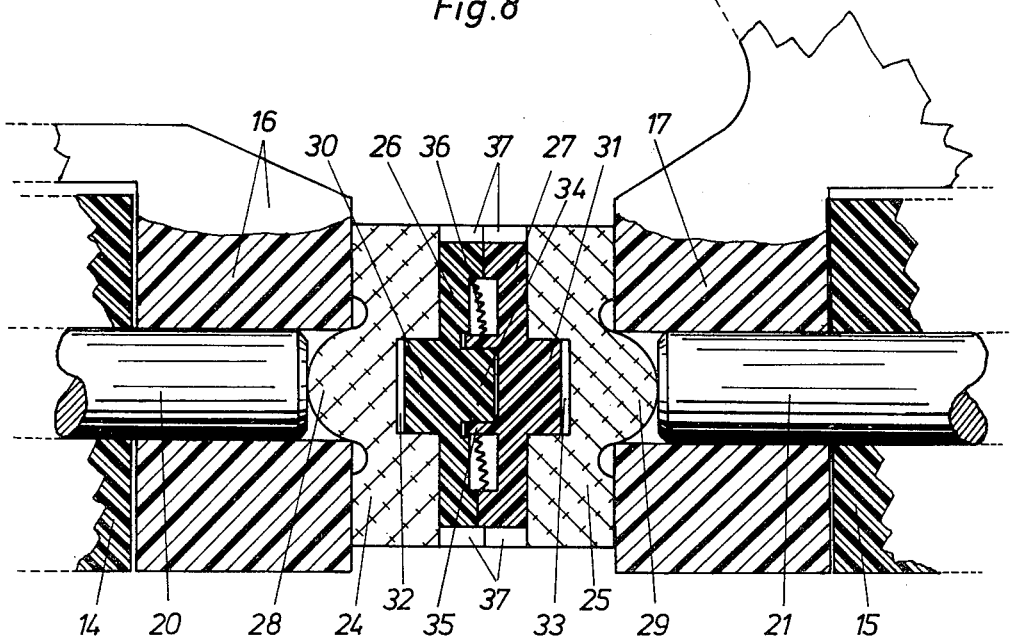
FIG. 9 is the individual components FIG. 8 in their operating position, between the hinge parts of the ski safety bracket (axial section through the hinge axis)

The frictional resistance, necessary for solving this task, may be predetermined within certain limits, by designing the abutting friction faces of the hinge parts 4,5 and the hinge piece 7 with low teeth, cif. especially FIG. 4. Jointly with the clamping force of the bracket part 1,2,3 clamped upon the hinge piece 7, the toothing 13 will provide a reliable resistance, predetermined ab initio, against folding down of the bracket. In FIGS. 5 to 10, a variant of the example of realization is shown. With the ski safety bracket described therein, adjusting of the frictional resistance between the hinge faces of the bracket and the hinge faces of the retaining plate can be made any time. Instead of the center hinge-piece 7 of the variant per FIGS. 1 to 4, hinge pieces 14,15 are incorporated here into the flanks of the retaining plate 6 abutting the corresponding hinge parts 16,17 of the bracket part 1,2,3 either—as shown—by way of friction surfaces that are smooth or by way of toothing as described afore. Inserted into each of the hinge bores 18 of the hinge 14,16 and also into the hinge bore 19 of the hinge 15,17 is one hinge pin 20 or 21 respectively and enclosed therein by plugs 22,23. When using correspondingly short hinge pins, and hinge bores 18,19 which do not extend through the outsides of the hinge pieces 14,15, these plugs can be avoided, by inserting on assembly the hinge pins from the inside (not shown).

Spring elements in the form of rubber discs 24,25 are resting against the inner surfaces of the hinge parts 16,17 of the ski safety bracket, two toothed discs 26,27 being wedged inbetween them. This arrangement is shown in detail in FIGS. 8 and 9. Each rubber disc 24,25 is provided with a bulbous end 28,29 extending into the hinge bores 18, 19 and thus centering the rubber discs. For the same purpose, centering dowels 30, 31 are incorporated into the toothed discs 26,27, extending into the corresponding bores 32,33 of the rubber discs 24,25. The two toothed discs 26,27 are centered in such a way that a centering dowel 34 incorporated into the toothed disc 26, will reach into a centering ring 35 on the other toothed disc 27.

The toothing 36 is arranged one each of the toothed discs 26, 27 in three angular sectors S, each of 120°. The height of the teeth of the toothing 36 is evenly rising helically within each of these angular sectors, namely from a lower value equal to all sectors to a higher value also equal for all three sectors, cif.

Figure 10:
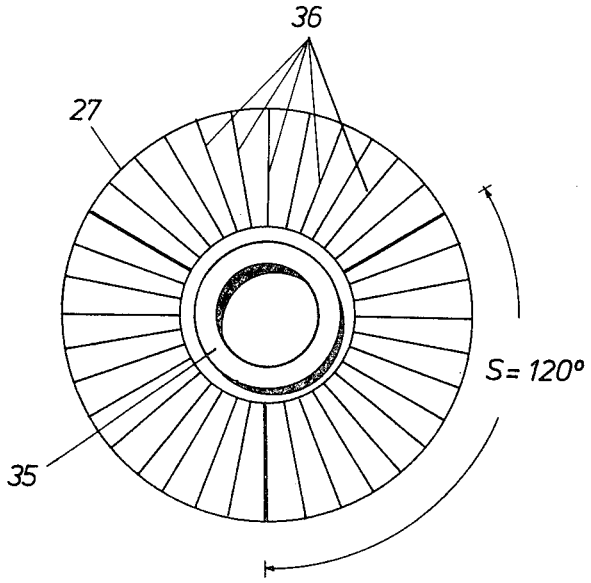
FIG. 10 is one of the toothed discs shown in FIGS. 8 and 9 in a top view and without grooves for gripping.
Figure 11:
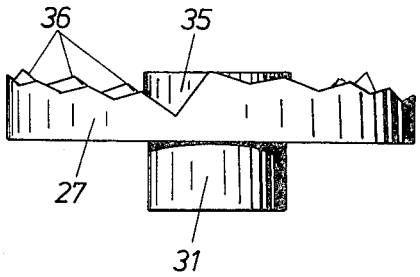
FIG. 11 is the toothed disc FIG. 10 in a side view.
Figure 12:
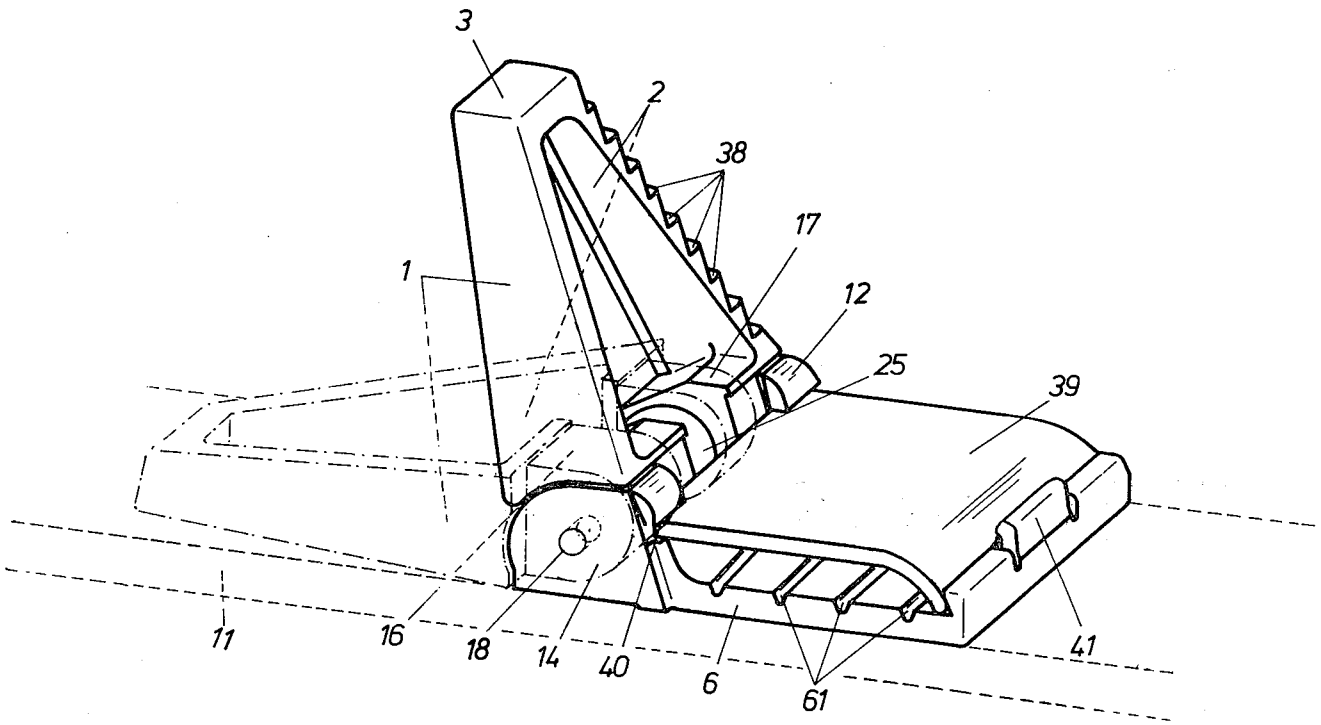
FIG. 12 is the ski safety bracket FIGS. 5 to 7 with protector plate, in perspectivic view.

FIGS. 10 and 11

Turning the toothed discs 26,27 relative to each other in the direction of the rise, they will be forced apart and exert a corresponding pressure onto to the rubber discs 24, 25 which, originally had been installed between the hinge part 16, 17 and the toothed discs 26, 27 under an initial pressure.

The rubber discs will transmit the additional pressure onto the hinge parts 16, 17 of the bracket, whereby the frictional resistance between the hinge parts 16, 17 and the hinge pieces 14, 15 of the retaining plate will increase. The maximum outward tension and thus the maximum additional pressure is reached at the end of an angular sector of the teeth, i.e., after 120° angular rotation from the lower plate of the toothing. In the same manner, reversed, the additional pressure can be reduced.

By this tensioning device, any desired frictional resistance can arbitrily be set at the hinge faces. To facilitate rotating of the toothed discs 26, 27 they are provided at the circumference with gripping grooves 37 running across the circumference. Instead of the gripping grooves, radial bores (not shown) may be used into which an adjusting pin is inserted.

The adjustable tension described herein, is not dependent upon using toothed discs and rubber discs, but it may be used with any suitable adjustable springing element acting axially upon the hinge parts 16, 17 of the bracket.

In order to deflect from the other ski of a pair of ski, a ski that has deviated from the direction of travel, the side member of the ski safety bracket pointing against the second ski must be relatively steeply inclined, in the example of realization about 80° . In the event that the crossing ski, caused by whichever irregularity in the slope, will still jump over the ski safety bracket, the skier must have the possibility of returning the ski into the direction of travel. For this purpose, the side member pointing outward has a smaller inclination, about 50°–60°, so that the ski may easier slide back. The ski safety bracket shown in FIGS. 5 to 10 shows outer side member 2 provided with stepped notches 38 intended to hamper sliding-down of the crossing ski.

Even after-folding down of the bracket part in case of a fall, the hinge parts which, by force of circumstance will still somewhat project upwards, and present a certain danger of injury, although this will be immeasurably less than the danger of a bracket standing upright. The danger of injury present at the hinge parts may be eliminated by a protector plate 39 shown in FIGS. 6 and 10 compensating the abrupt differences in height caused by the hinges. The protector plate 39 is inserted into a slot 40 at the stop 12 of the retaining plate 6, and it is held down by a spring-loaded sliding hook 41 incorporated into the rear part of the retaining plate. The hollow space between the retaining plate 6 and the protector plate 39 may be used for looping through of, for instance, rubber rings or straps (not shown) to hold the skis together during transportation.

It will be understood that each of the elements described above, or two or more together, may also find a useful application in other types of constructions differing from the types described above.

While the invention has been illustrated and described as embodied in a safety device for skis, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A ski safety device for deflecting a ski leaving its direction from crossing over the other ski, the device comprising two brackets each arranged between the tip of the ski and the ski binding of each ski and movable relative to the latter between a normal position in which said bracket extends substantially upright relative to the respective ski, and a folded position in which said bracket folds down toward the respective ski, each of said brackets has two side members spaced from one another in said transverse direction; means for mounting each of said brackets on the respective ski for movement between said positions; said mounting means being arranged so that each of said brackets moves between said positions about a pivot axis located adjacent to the respective ski and extending in a direction which is transverse to the direction of travel, said mounting means including two first hinge members provided on each ski in the region of longitudinal edges of the latter and two second hinge members connected with said side members of each bracket and located between said two first hinge members in association therewith; means for offering resistance to the movement of each of said brackets from said normal position to said folded down position, said resistance offering means including adjustable tension means arranged between said second hinge members of each bracket; and means for adjusting the resistance offered by said resistance-offering means.

2. A device as defined in claim 1, and further comprising means for limiting the movement of each bracket from said folded position to said normal position.

3. A device as defined in claim 2, wherein said limiting means includes a stop member provided for each of said brackets.

4. A device as defined in claim 1, wherein said mounting means includes a retaining plate connected with each of the skis, and a stop member for limiting the movement of each bracket from said folded position to said normal position, said stop member and said first hinge member being provided on said retaining plate of the same ski.

5. A device as defined in claim 4, wherein said stop member and said first hinge member of each ski are of one piece with said retaining plate of the same ski.

6. A device as defined in claim 5, wherein each of said retaining plates is provided with a plurality of flutes which impart elasticity thereto.

7. A device as defined in claim 1, wherein said first hinge member of each ski and said second hinge member of said bracket of the same ski have contact surfaces which abut against one another and is provided with teeth forming said resistance-offering means.

8. A device as defined in claim 1, wherein said side member of each of said brackets includes an inner side member facing toward the other bracket, and an outer side member facing away from the other bracket and spaced from the inner side bracket in said transverse direction, said inner side member being inclined by an angle of 80° and said outer side member being inclined by an angle of 60° to the plane of each ski.

9. A device as claimed in claim 8, wherein each of said outer side members is provided with a plurality of notches.

10. A device as defined in claim 1, wherein said mounting means includes a retaining plate connected to each of the skis and carrying said first hinge member; and further comprising a protecting plate extending from each of said retaining plates in the direction of travel.

11. A device as defined in claim 10, wherein said retaining plate has an end portion facing toward the binding of the respective ski, said protecting plate extending from said end portion of said retaining plate.

12. A device as defined in claim 1, wherein said second hinge members have inner surfaces, said tension means including two toothed discs and rotatable about a common axis, and two spring elements against which said toothed discs abut and which abut with pretensioning against said inner surfaces of said second hinge members so as to provide for abutment of said second hinge members against said first hinge members.

13. A device as defined in claim 12, wherein each of said toothed discs has a plurality of teeth arranged in three angular sectors of substantially equal dimensions and helically rising so that the teeth having their lowest height are provided at the beginning of each angular sector, and the teeth having their greatest height are provided at the end of each angular sector, so that by turning of said toothed discs relative to one another, force with which said discs act upon said second hinge members through said spring members can be adjusted, and whereby the abutment of said second hinge members against said first hinge members and thereby the resistance to the movement of said brackets can also be adjusted, wherefore said helically rising angular sectors of said teeth of said toothed members form said resistance-adjusting means.

14. A device as defined in claim 13, wherein each said angular sector includes three teeth which are the lowest and located in a common low plane and three highest teeth which are the highest and located in a common high plane.

15. A device as defined in claim 12, wherein each of said discs is provided with a plurality of gripping grooves arranged around the circumference of the same.

* * * * *